US005892484A

United States Patent [19]

MacGahan

[11] Patent Number: 5,892,484

[45] Date of Patent: Apr. 6, 1999

[54] E-FIELD GENERATOR

[75] Inventor: Jonathan P. MacGahan, Ivyland, Pa.

[73] Assignee: Amplifier Research Corporation, Souderton, Pa.

[21] Appl. No.: 741,473

[22] Filed: Oct. 30, 1996

[51] Int. Cl.[6] ..... H01Q 9/26

[52] U.S. Cl. ..... 343/740; 343/744; 343/803; 343/821

[58] Field of Search ..... 343/744, 803, 343/860, 739, 740, 821; H01Q 9/26, 11/14, 9/10

[56] References Cited

U.S. PATENT DOCUMENTS

| | | | |
|---|---|---|---|
| 2,281,429 | 4/1942 | Goddard . | |
| 2,283,914 | 5/1942 | Carter . | |
| 2,283,938 | 5/1942 | McKesson . | |
| 2,285,669 | 6/1942 | Lehmann . | |
| 4,028,707 | 6/1977 | Young et al. | 343/803 |
| 4,115,778 | 9/1978 | Snow | 343/803 |
| 4,121,219 | 10/1978 | O'Conner | 343/803 |
| 4,423,423 | 12/1983 | Bush . | |

*Primary Examiner*—Michael C. Wimer
*Attorney, Agent, or Firm*—Howson and Howson

[57] ABSTRACT

An E-field generator for r.f. susceptibility testing comprises first and second conductive arms, each comprising a conductor having a U-shaped portion. A driving circuit connected to first ends of each conductor delivers r.f. power to the arms. A load resistance is connected between the opposite ends of the conductors. The U-shaped portions of the elements are disposed opposite each other in spaced relationship so that a device to be tested can be positioned between them. The elements are mounted on a housing which encloses the load resistance as well as a 9:1 balun. The elements are removably secured in clamps, and the housing has provisions for mounting in alternative positions.

21 Claims, 7 Drawing Sheets

E-FIELD GENERATOR

SUMMARY OF THE INVENTION

This invention relates generally to radio frequency susceptibility testing, and more particularly to improvements in E-field generators, that is energy transducers used for exposing devices under test to a high-intensity electric field swept over a band of frequencies, usually in the range from about 10 kHz to about 1 GHz.

The proliferation of cellular telephones, garage door openers, and other devices generating r.f. signals, has made it necessary to carry out susceptibility testing on a wide variety of products. These include, for example, computerized automotive electrical systems, medical devices such as electrocardiography equipment, personal computers, and numerous other items which can malfunction when exposed to unwanted electromagnetic fields.

A conventional antenna can be used for r.f. susceptibility testing. However, an antenna typically has a limited bandwidth, a highly frequency-dependent field pattern, wide spatial variations in field intensity at any given frequency, and high power requirements. Unlike a conventional antenna, an E-field generator can be used to carry out r.f. susceptibility testing rapidly, over a broad range of frequencies, and with comparatively low r.f. driving power.

E-field generators have historically fallen into two broad categories. The first is the unterminated type, in which the electric field is drawn between two parallel, open-ended conductors in a capacitor-like fashion. A typical E-field generator of the unterminated type comprises two spaced, parallel elements having their centers connected to opposite terminals of a signal source, and a resistive load connected directly to the signal source. The second category is the transmission line type, in which the r.f. source and a resistive load are placed at opposite ends of a large, two-conductor transmission line, which generates both E and H fields.

The bandwidth of the unterminated type of E-field generator is quite limited, for as the frequency increases toward the point at which the length of the elements is ¼ wavelength, the source is effectively short-circuited, making the generator unusable. The transmission line type of E-field generator does not have this limitation. However, because its source and load are at opposite ends of the structure, it tends to be large, awkward and expensive.

The principal object of this invention is to provide an improved E-field generator that is not subject to the bandwidth limitation of the unterminated type of generator, but is at the same time compact, simple and easily supported. Another important object of the invention is to provide an E-field generator having a high degree of spatial E-field uniformity over a broad frequency range.

The E-field generator in accordance with the invention comprises first and second conductors, each having a U-shaped portion. A driving circuit connected to first ends of the conductors delivers r.f. power to the conductors. The other ends of the conductors are preferably connected to each other through a load resistance. The generator is characterized by the fact that the U-shaped portions of the conductors are disposed opposite each other in spaced relationship with the legs of both U-shaped portions transversely intersecting an imaginary plane, allowing a device under test to be positioned between them.

The generator may be in the form of a folded dipole the arms of which are bent so that outer portions of the arms are disposed opposite each other in spaced relationship.

Preferably, the U-shaped portions, or the outer portions of the arms in the case of a folded dipole, are disposed substantially in spaced, parallel planes.

The input impedance of the generator, measured at the first ends of the conductors, is not highly dependent on the shapes of the arms or on the spacings of the elements of the arms. It is influenced more heavily by variations in the relative thicknesses of the elements. The elements, however, are preferably of constant thickness. The input impedance is also affected by the presence and value of the load resistance, which is preferably approximately 450 ohms. This results in a nominal input impedance of approximately 450 ohms. The driving circuit can then be a 9:1 balun transformer having an input impedance of approximately 50 ohms, matching the standard 50 ohm output of most available broadband r.f. amplifiers.

The driving circuit and the load resistance are preferably located within an enclosure, the arms are removably connected to the enclosure by clamping means attached to the enclosure, and at least two mounting means are provided for selectably mounting the enclosure, with the arms connected thereto, in either of two mutually orthogonal positions.

The E-field generator of the invention is not only simple, inexpensive, compact and broadbanded, but also exhibits a surprisingly good spatial E-field uniformity. It is also versatile in that it can be mounted in any of several positions, and the conductors can be replaced by conductors of different sizes to accommodate different sizes of devices under test.

Other objects, details and advantages of the invention will be apparent from the following detailed description when read in conjunction with the drawings.

DETAILED DESCRIPTION

Figure 1:
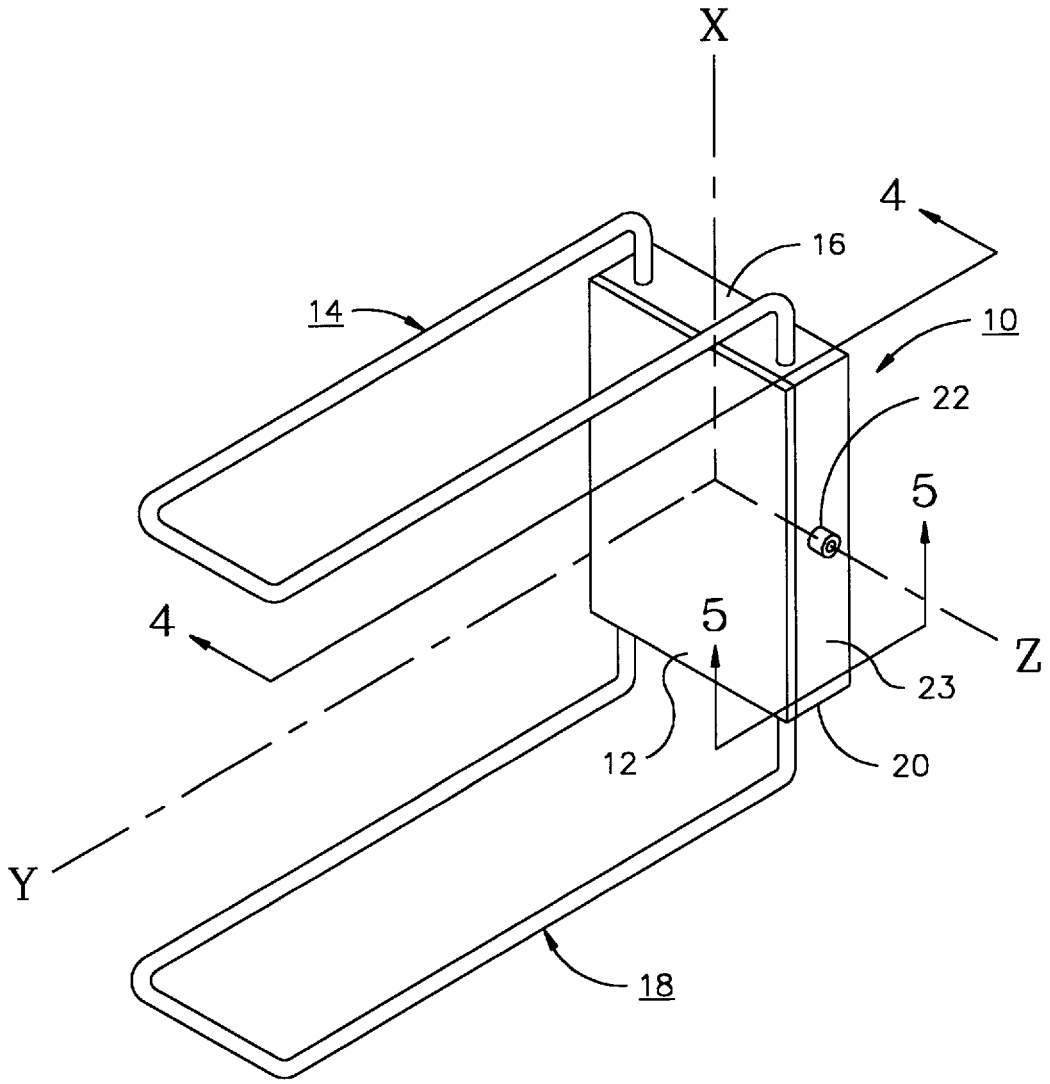
FIG. 1 is a perspective view of an E-field generator in accordance with the invention.

As seen in FIG. 1, the E-field generator comprises an enclosure 10, which takes the form of a rectangular box, preferably made from a non-conductive plastics material to avoid distortion of the field. The enclosure has a front cover 12. A first conductive arm 14, preferably of thinwall aluminum tubing, extends upward and then forward from the top wall 16 of the enclosure, and a second arm 18, which is identical to arm 14, extends downward and then forward from the bottom wall 20 of the enclosure. The forwardly extending portions of the arms are U-shaped and disposed directly opposite each other in substantially parallel, spaced planes so that the legs of the U-shaped portions intersect an imaginary plane so that the legs of the U-shaped portions intersect an imaginary plane. Thus, the arms 14 and 18 are essentially mirror images of each other.

A coaxial connector 22 is provided on a side 23 of the enclosure for connection to an r.f. power source, which will ordinarily be a broadband r.f. power amplifier driven by an r.f. source capable of being swept through the range of frequencies of interest.

Figure 4:
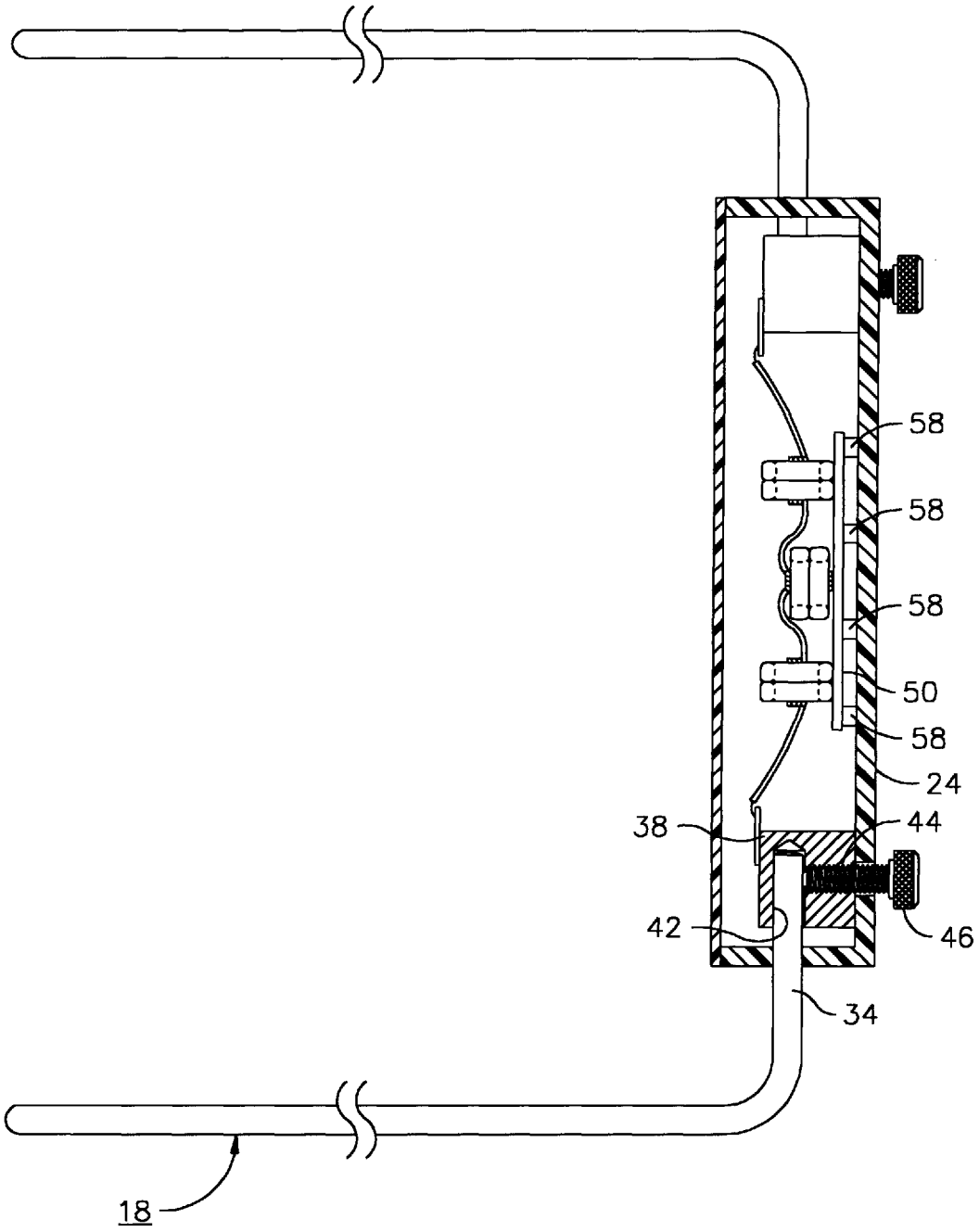
FIG. 4 is a sectional view taken on plane 3—3 of FIG. 1.

As shown in FIG, 2, the arms 14 and 18 are supported in metal blocks mounted inside the enclosure on its rear wall 24. Thus, the vertical parts 26 and 28 of arm 14 are secured respectively in blocks 30 and 32. Likewise the vertical parts 34 and 36 of arm 18 are secured respectively in blocks 38 and 40. These vertical parts of the arms extend through holes formed in the top and bottom walls 16 and 20 of the enclosure. FIG. 4 shows how the arms are clamped in the blocks. Block 38, for example, receives part 34 of arm 18 in a hole 42, and part 34 is removably secured to the block by a clamping screw 44, which is threaded into the block and operated by an externally accessible knob 46. Each of the other blocks is similarly provided with a clamping screw. Thus, it is possible to disassemble the apparatus quickly by removing the arms, so that it can be transported conveniently. Furthermore, the clamping blocks make it easy to substitute arms of different sizes to accommodate different devices under test and to modify the frequency range and field characteristics of the apparatus.

Referring again to FIG. 2, the coaxial connector 22 is connected to blocks 32 and 40 through a transformer 48. The impedance at blocks 32 and 40 will be approximately 450 Ω. Since the output impedance of the driving amplifier will ordinarily be approximately 50Ω, and the apparatus will be driven through a 50Ω coaxial cable, the transformer is designed to serve as a 9:1 impedance matching transformer. The transformer should also function as a balun, to avoid currents on the shield of the coaxial feed line which would cause unpredictable distortions of the generated field.

Figure 2:
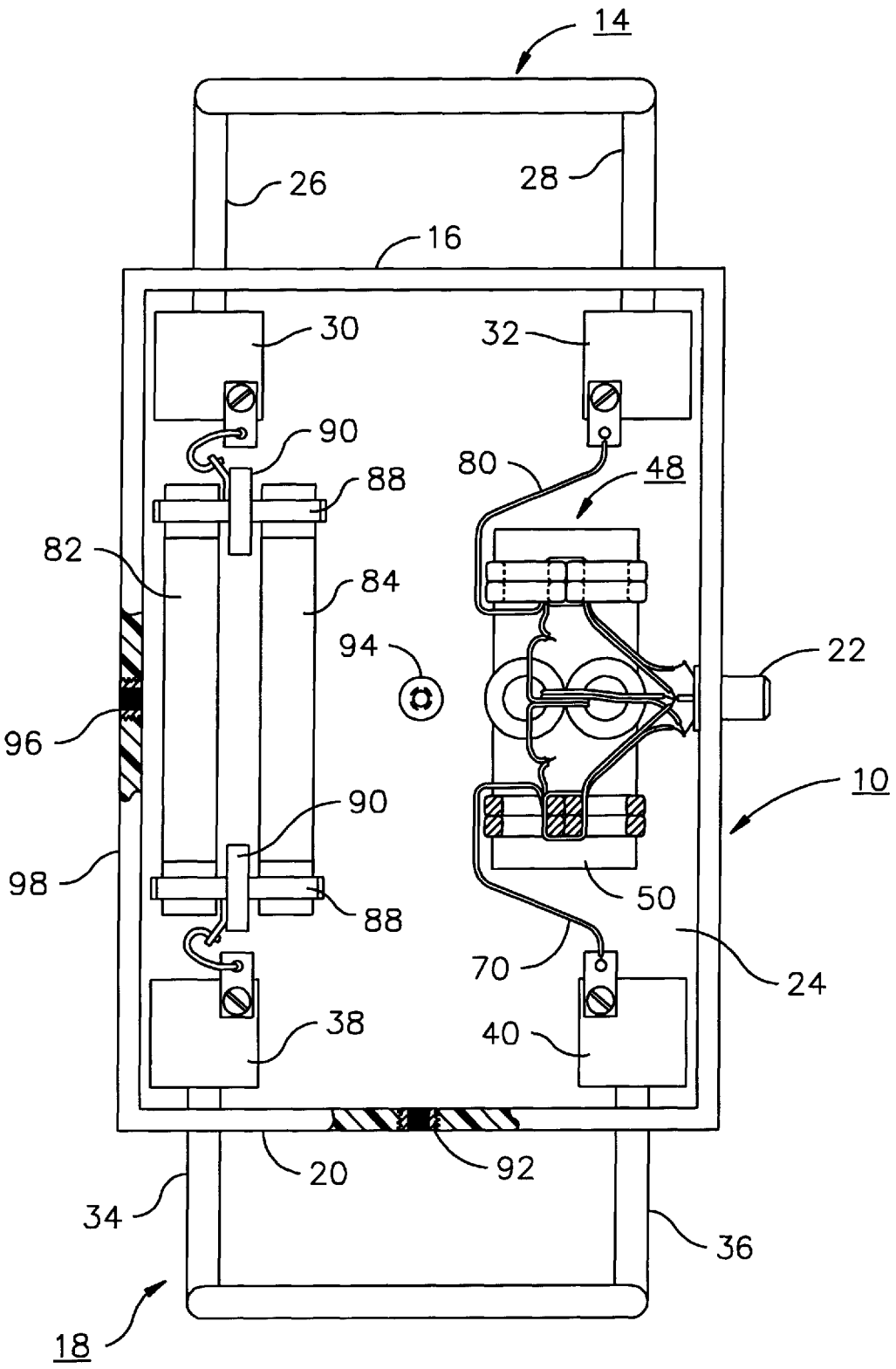
FIG. 2 is a front elevation, partly in section, of the E-field generator with the front cover removed to show internal details.
Figure 3:
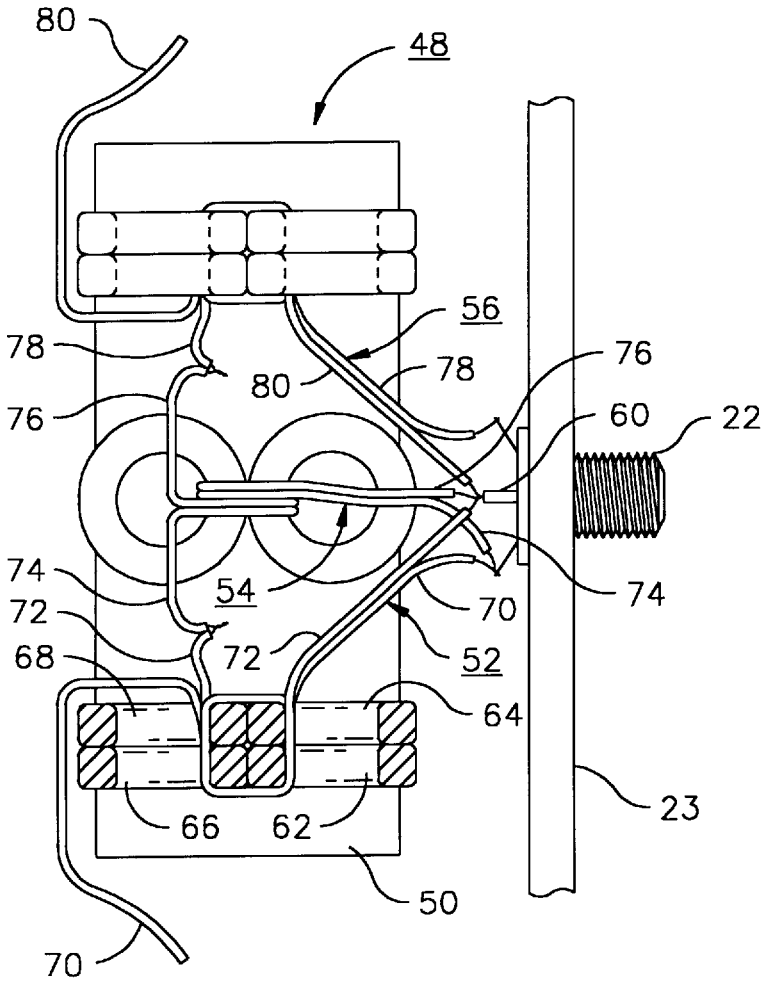
FIG. 3 is an enlarged elevational view of a transformer shown in FIG. 2.

The transformer comprises three parallel-conductor transmission lines 52, 54 and 56, wound respectively on three sets of ferrite toroids. The toroids are supported on an insulating board 50 mounted by means of stand-off supports 58 (FIG. 4) on the rear wall 24 of the enclosure. Each parallel-conductor transmission lines comprises two parallel insulated wires. The size and spacing of the conductors of these parallel-conductor transmission lines should be such that the transmission lines have a characteristic impedance of 150Ω, i.e. the geometric mean of the desired input and output impedances, 50Ω and 450Ω, respectively. As shown in FIG. 2, one conductor of each of the lines 52, 54 and 56 is connected to the center conductor 60 of the coaxial connector 22, while the other conductor of each line is connected to the outer conductor of the coaxial connector. Line 52 is wound on a core consisting of four toroids 62, 64, 66 and 68. The other lines, 54 and 56 are similarly wound on cores consisting of ferrite toroids. For clarity, only one turn is shown for each winding; in practice the number of turns in each winding will ordinarily be greater than one, for example six.

The opposite ends of the lines are connected in series between the blocks 40 and 32. Thus, the end of conductor 70 of line 52 is connected to block 40. The end of conductor 72 of line 52 is connected to the end of conductor 74 of line 54. The end of conductor 76 of line 54 is connected to the end of conductor 78 of line 56. The end of conductor 80 of line 56 is connected to block 32.

The transformer serves as a 9:1 balun transformer, matching the 50Ω impedance at the coaxial connector to the 450Ω, impedance at blocks 32 and 40. The drawing of the transformer windings in FIG. 2 is simplified. In practice, each winding preferably consists of six turns. The number of turns and the presence of the ferrite cores provide sufficient common mode inductive reactance in the transmission lines to prevent shorting out of the transformer.

Figure 5:
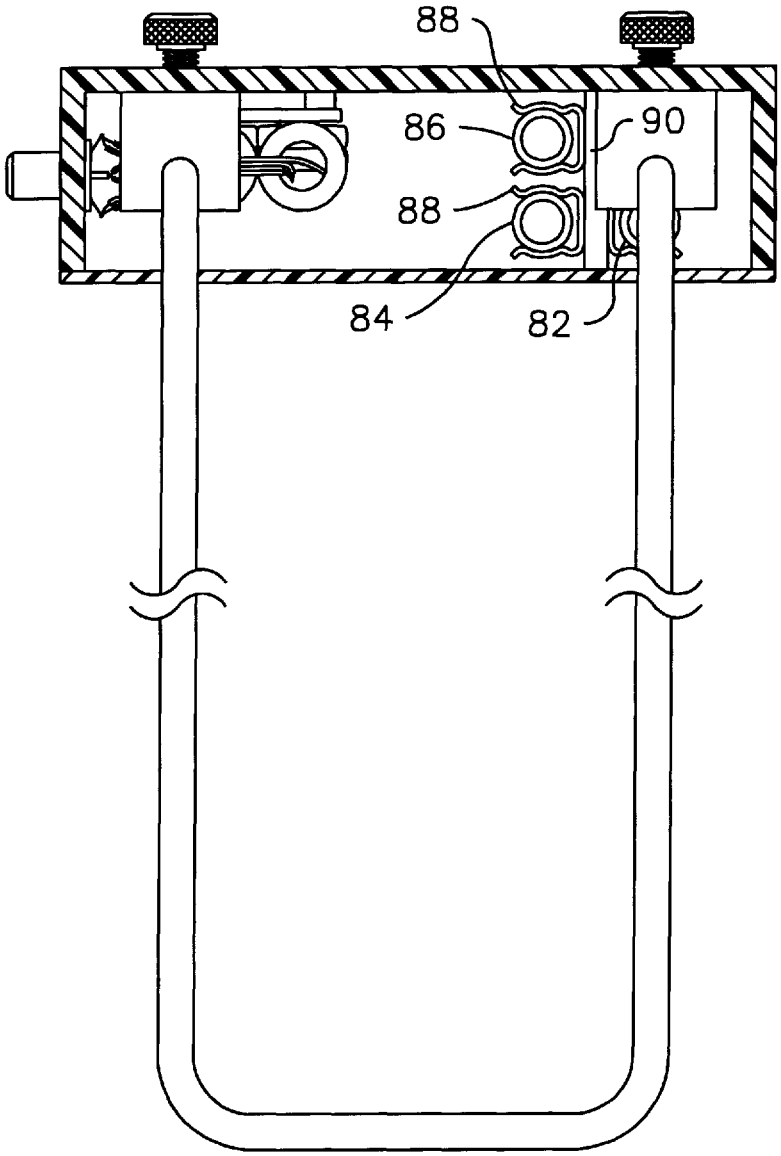
FIG. 5 is a sectional view taken on plane 4—4 of FIG. 1.

Blocks 30 and 38, which receive parts 26 and 34 of the tubular arms, are connected to the opposite ends of an array of four resistors connected in parallel with one another. These resistors, two of which, 82 and 84, are seen in FIG. 2, and another, 86 is shown in FIG. 5, are mounted in clips 88 on insulating blocks 90. The total resistance connected between blocks 30 and 38 should be 450Ω. Consequently, each of the four parallel resistors should have a resistance of 1800Ω.

The 450Ω load resistance results in an input impedance, measured at blocks 32 and 40, which is nominally 450Ω, and varies only insignificantly over a broad range of frequencies.

Threaded metal inserts 92, 94 and 96 are provided in bottom wall 20, rear wall 24 and side wall 98 of the enclosure. These inserts have internal threads, preferably of a standard size, e.g. ¼×20, to receive the threads of a standard tripod mount. By selecting insert 92, the apparatus can be mounted with arms 14 and 18 respectively above and below the device under test. By selecting insert 94, the enclosure 10 can be positioned below the device under test, with the tubular arms extending upwardly on either side of the device. By selecting insert 96, the enclosure 10 can be positioned behind the device under test, with the tubular arms extending laterally on either side of the device.

The shape and dimensions of the arms 14 and 18 are design parameters chosen on the basis of the desired maximum frequency of operation, the size of the device under test, and the required field intensity. Both the input impedance match and the field characteristics ultimately deteriorate as the frequency is increased. Larger, more widely spaced arms provide lower upper frequency capability and weaker field strengths, for a given power input, but will accommodate larger equipment. Thus, several geometries may be desired in order to accommodate a variety of test scenarios. A set of small arms would allow testing of smaller devices at frequencies up to 100 MHz, for example. A larger set would allow testing of larger devices, but would have a lower upper frequency limit and would require more power than the small arms to provide a given field intensity.

A prototype of the field generator has been tested. The resistance and matching balun transformer were housed in a non-metallic enclosure measuring 10×50×40 cm, and the prototype was designed to handle a power level of 500 W and to be capable of producing a field strength of 200 V/m for testing.

The performance of the prototype was modeled using a method-of-moments electromagnetics computer code with near-field capability. The accuracy of the computer model was verified by spot comparisons against measured field-strength data. These measurements were made on the prototype using an E-field probe in a near free-space test environment. The computer model was necessary because acquisition of measured data on a point by point and frequency by frequency basis is prohibitively time consuming.

Two geometries were evaluated. The first, in which the U-shaped portions of the arms were each 96 cm in length and spaced from each other by 71 cm, was chosen to approximate the size of a common E-field generator of the unterminated type so that direct performance comparisons could be made. The second, in which 96 cm U-shaped portions were spaced from each other by 96 cm, was intended to accommodate larger devices under test, including a standard 48 cm wide equipment enclosure.

The input VSWR of the E-field generator using the smaller arms was under 1.6:1 from 30 kHz through 100 MHz and under 2.2:1 from 10 kHz to 30 kHz. With the larger arms, the VSWR was virtually identical below 20 MHz but increased above 20 MHz to about 2:1 at 100 MHZ.

The Cartesian coordinate system shown in FIG. 1 will be used in describing the field characteristics of the generator. The origin is located at the center of the base, lying in a plane with the resistor and transformer. The polarization of the electric field in the test zone is predominantly in the x direction, with y and z components generally down by 20 dB or more. The field plots in FIGS. 5–10 pertain to the version with the smaller elements. The characteristics of the E-field generator with the larger elements are essentially similar except that the field levels are reduced to about 60% of their value with the small elements, and the width of the test zone in the x direction is increased by about 30%. All of the field plots were computed for an input power level of 10 watts.

Figure 6:
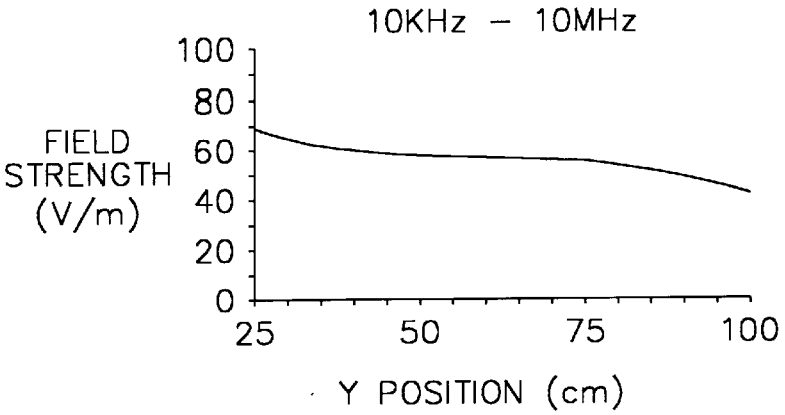
FIGS. 6–11 are plots showing the spatial variation of field strength for a typical E-field generator in accordance with the invention.
Figure 7:
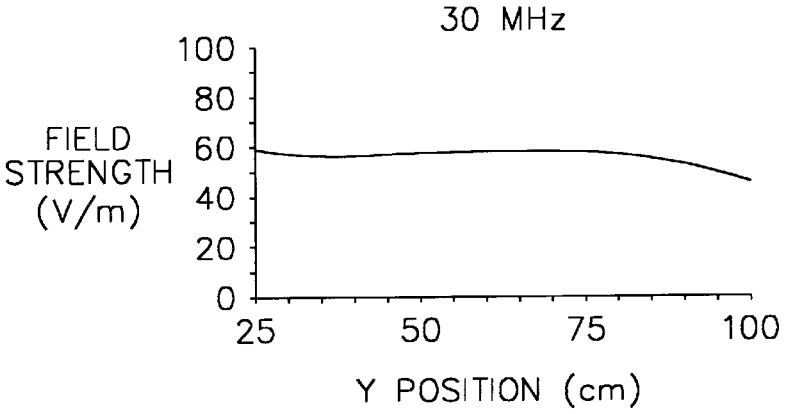
Figure 8:
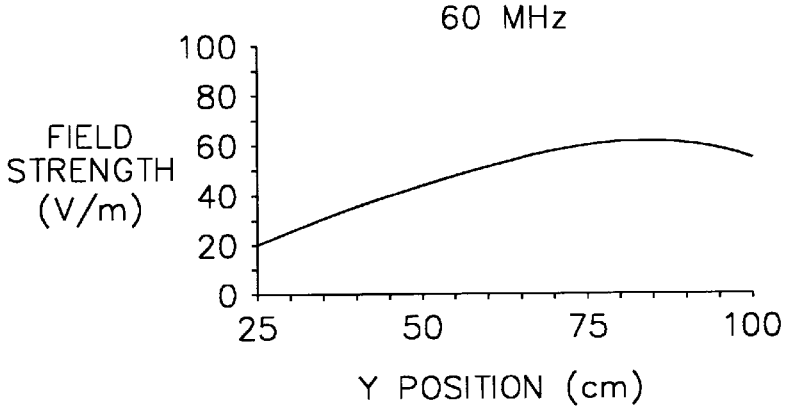
Figure 9:
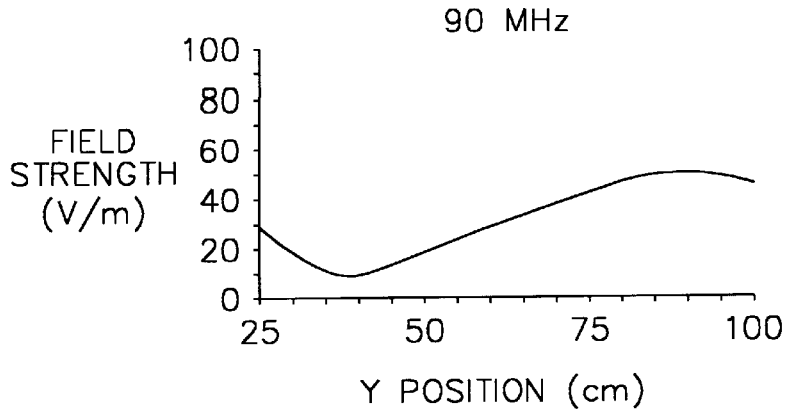

Plots of field strength versus the y position for the small arms are shown in FIGS. 5–8. These plots show the field strength along the centerline of the generator, that is at x=0 and z=0, for different frequencies. The field strength along the center line is virtually independent of frequency from 10 kHz through 10 MHz, and is depicted in FIG. 6. Above 10 MHz, the shape changes, flattening out at 30 MHz as shown in FIG. 7 and then developing a relative peak at 60 MHz as shown in FIG. 8. Above 60 MHz the peak narrows and shifts higher in y, as shown in FIG. 9, the plot for 90 MHz. At 100 MHz, the shape is similar to that for 90 MHz, but the level drops off from a maximum of 50 V/m at 90 MHz to a maximum of 43 V/m at 100 MHz. The field continues to drop off at frequencies above 100 MHz.

These plots shown in FIGS. 5–8 demonstrate that, when operating the field generator at frequencies below 40 MHz, the best field uniformity and field intensity, and hence the best location for the device under test, occur at a y position of about 61 cm. For operation between 40 MHz and 60 MHz the best location is at a y position of about 74 cm. For operation from 60–80 MHz, the best y position is at 81 cm, and above 80 MHz, the best y position is 84 cm. The best compromise y position when operating over the full 10 kHz to 100 MHz band is at about 76 cm.

Figure 10:
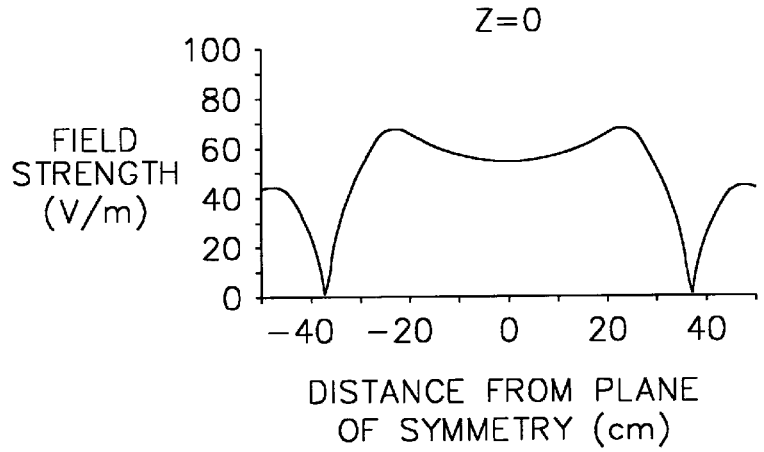
Figure 11:
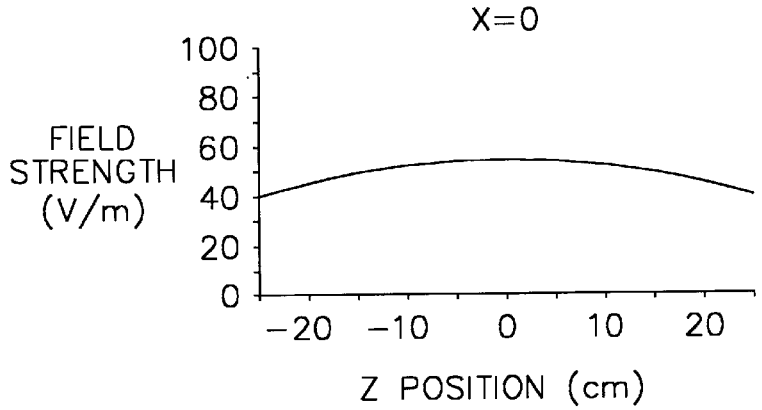

Field strength plots, showing the variation in field level in the x and z directions for the smaller elements, are shown in FIGS. 10 and 11 respectively. These plots were computed at a y position of 76 cm. The shapes of these plots are virtually invariant with frequency throughout the range from 10 kHz through 100 MHz. However, their average levels shift up and down with frequency, in a manner corresponding to the shift of field intensity with frequency observed in comparing FIGS. 6, 7, 8 and 9.

Because of its four dimensional nature (x, y, z, and frequency), field uniformity in the test zone volume is the most difficult characteristic to quantify and to describe. A common requirement for susceptibility testing is that the variation in field level within the test zone volume relative to some normal field level be ±3 dB or less. Using this criterion to define the extent of the usable test volume, the following table shows the size and position of the test volume as a function of frequency, and the corresponding nominal field levels assuming an input power level of 10 watts.

| Frequency | Nominal Field (10 watt input) | Test Zone Size Δx × Δy × Δz | Test Zone Center x y z |
|---|---|---|---|
| 10 kHz–40 MHz | 52 V/m | 41 × 71 × 41 cm | 0, 61, 0 cm |
| 40 MHz–60 MHz | 54 V/m | 36 × 58 × 41 cm | 0, 74, 0 cm |
| 60 MHz–80 MHz | 54 V/m | 36 × 41 × 41 cm | 0, 81, 0 cm |
| 80 MHz–90 MHz | 52 V/m | 36 × 36 × 41 cm | 0, 84, 0 cm |
| 90 MHz–100 MHz | 46 V/m | 36 × 36 × 41 cm | 0, 84, 0 cm |

The field strength in the test zone is proportional to the square root of the input power to the E-field generator.

Any E-field generator will radiate to some degree. The highest radiation efficiency for this E-field generator using the smaller elements occurs at a frequency of about 90 MHz and is approximately 20%. That is, 20% of the power is radiated and 80% is dissipated in the resistors 82, etc. and elsewhere. The maximum gain is approximately −2 dBi and the radiation pattern is bi-directional along the x axis.

Susceptibility test are often conducted in shielded rooms. Unfortunately, the shielded environment has a tremendous impact in the performance of antennas, and to a lesser extent, field generators. Coupling to the walls, ceiling, floor, and the contents of the room can corrupt the uniformity of the generated field. Thus, the E-field generator in accordance with the invention should be kept as far from conducting surfaces as possible. In case there is any doubt about disturbances affecting the uniformity of the field, the field levels in the vicinity of the equipment under test should be measured using a field probe. The field generator and equipment under test can be repositioned within the room to achieve satisfactory field levels and uniformity.

The room may also act as a large resonator, "ringing up" at specific frequencies. Absorptive material may be placed in the room at appropriate locations to avoid, or reduce the effects of, resonance.

The fields created by the E-field generator are predominantly non-propagating, and tend to diminish rapidly with distance from the elements. Thus, the equipment under test is ideally placed between the elements. However, larger devices, that cannot be placed between the elements, can be tested by locating them off to the side. In such situations, as in the case where there are reasons to doubt the uniformity of the field, the field levels should be measured using a probe. The power level and the location of the device under test can be adjusted accordingly.

Various modifications can be made to the apparatus described. For example, load resistors need not be connected directly between parts 26 and 34 of the two arms 14 and 18. A load resistance can be effectively placed between parts 26 and 34 by connecting them, through a transformer similar to transformer 48, and a transmission line, to a remotely located resistor or set of resistors. In this case, the transformer, transmission line and resistor or set of resistors constitute the load resistance. Element geometries can be varied to accommodate larger devices under test and to extend operation to higher frequencies. Furthermore, improvements in field uniformity and high frequency field intensity may be possible with minor modifications, e.g. partial curvature, to the shapes of the elements.

Still other modifications may be made to the apparatus and method described above without departing from the scope of the invention as defined in the following claims.

I claim:

1. An E-field generator comprising first and second conductors, each having a U-shaped portion and first and second ends, each of the U-shaped portions consisting of two legs and a connection extending from one leg to the other leg, means, comprising a driving circuit connected to the first ends of the conductors, for delivering r.f. power to the conductors, and a load resistance, the second ends of the conductors being connected to each other through the load resistance, wherein the U-shaped portions of the conductors are disposed opposite each other in spaced relationship and the legs of both U-shaped portions transversely intersect an imaginary plane, whereby a device to be tested can be positioned between said U-shaped portions.

2. An E-field generator according to claim 1 in which the U-shaped portions of the conductors are disposed substantially in spaced, parallel, planes.

3. An E-field generator according to claim 1 which the driving circuit comprises a step-up balun transformer.

4. An E-field generator according to claim 1 in which the load resistance is such that the impedance at the first ends of the conductors is approximately 450 ohms.

5. An E-field generator according to claim 4 in which the driving circuit comprises a balun transformer having an input impedance of approximately 50 ohms, and having an output impedance at the first ends of the conductors of approximately 450 ohms.

6. An E-field generator according in claim 4 in which the load resistance is approximately 450 ohms.

7. An E-field generator according to claim 1 including a support, in which the conductors are connected to the support, and having at least two mounting means for selectably mounting said support, with the conductors connected thereto, in either of two mutually orthogonal positions.

8. An E-field generator according to claim 1 including a support and clamping means attached to the support, and in which the conductors are removably connected to the clamping means.

9. An E-field generator according to claim 1 including an enclosure, in which the driving circuit comprises a transformer, in which the driving circuit and the load resistance are located within the enclosure, in which the conductors are connected to the enclosure, and having at least two mounting means for selectably mounting said enclosure, with the conductors connected thereto, in either of two mutually orthogonal positions.

10. An E-field generator according to claim 1 including an enclosure, in which the driving circuit comprises a transformer, in which the driving circuit and the load resistance are located within the enclosure, in which the conductors are connected to the enclosure, and having clamping means attached to the enclosure, and in which the conductors are removably connected to the clamping means.

11. An E-field generator comprising a folded dipole having a pair of arms located on opposite sides of a central location, wherein each arm comprises an inner portion adjacent to the central location, and a U-shaped outer portion remote from the central location, each U-shaped portion consisting of two legs and a connection extending from one leg to the other leg, wherein the inner portions of the arms are substantially aligned with each other and extend in opposite directions from the central location, and the arms are bent so that the U-shaped outer portions of the arms are disposed opposite each other in spaced relationship, and the legs of both of said U-shaped outer portions transversely intersect an imaginary plane, whereby a device to be tested can be placed between said outer portions.

12. An E-field generator according to claim 11 in which the outer portions of the arms are disposed substantially in spaced parallel planes.

13. An E-field generator according to claim 11 including a support, in which the arms are connected to the support, and having at least two mounting means for selectably mounting said support, with the arms connected thereto, in either of two mutually orthogonal positions.

14. An E-field generator according to claim 11 including a support and clamping means attached to the support, and in which the arms are removably connected to the clamping means.

15. An E-field generator according to claim 11 in which each arm comprises first and second conductive elements, each conductive element having an inner end adjacent to the central location and an outer end remote from the central location, the outer ends of the conductive elements of each arm being connected together by one of said connections, and also comprising a driving circuit connected to the inner ends of the first conductive elements, for delivering r.f. power to the conductive elements, and a load resistance connected from the inner end of the second conductive element of one of the arms to the inner end of the second conductive element of the other arm.

16. An E-field generator according to claim 15 which the driving circuit comprises a step-up balun transformer.

17. An E-field generator according to claim 15 in which the load resistance is such that the impedance at the inner ends of the first conductive elements is approximately 450 ohms.

18. An E-field generator according to claim 17 in which the driving circuit comprises a balun transformer having an input impedance of approximately 50 ohms, and having an output impedance at the inner ends of the first conductive elements of approximately 450 ohms.

19. An E-field generator according to claim 17 in which the load resistance is approximately 450 ohms.

20. An E-field generator according to claim 15 including an enclosure, in which the driving circuit comprises a transformer, in which the driving circuit and the load resistance are located within the enclosure, in which the conductive elements are connected to the enclosure, and having at least two mounting means for selectably mounting said enclosure, with the conductive elements connected thereto, in either of two mutually orthogonal positions.

21. An E-field generator according to claim 15 including an enclosure, in which the driving circuit comprises a transformer, in which the driving circuit and the load resistance are located within the enclosure, in which the conductive elements are connected to the enclosure, and having clamping means attached to the enclosure, and in which the conductive elements are removably connected to the clamping means.

* * * * *